US005111961A

United States Patent [19]

Van Melle

[11] Patent Number: 5,111,961

[45] Date of Patent: May 12, 1992

[54] CUP LID

[75] Inventor: Hubert Van Melle, Etobicoke, Canada

[73] Assignee: Amhil Enterprises Ltd., Mississauga, Canada

[21] Appl. No.: 625,025

[22] Filed: Dec. 10, 1990

[51] Int. Cl.[5] ..... A47G 19/22

[52] U.S. Cl. ..... 220/712; 220/254; 220/306; 220/335; 220/339; 220/367

[58] Field of Search ..... 220/90.2, 90.4, 90.6, 220/254, 306, 335, 337, 339, 367, 711, 712; 229/906.1

[56] References Cited

U.S. PATENT DOCUMENTS

| | | | |
|---|---|---|---|
| 3,977,559 | 8/1976 | Lombardi | 220/90.4 |
| 3,994,411 | 11/1976 | Elfelt et al. | 220/90.4 |
| 4,103,804 | 8/1978 | Fourrier et al. | 220/281 |
| 4,202,459 | 5/1980 | DeParales et al. | 220/90.4 |
| 4,322,015 | 3/1982 | Bailey | 220/90.2 |
| 4,460,103 | 7/1984 | Rama et al. | 220/254 |
| 4,473,167 | 9/1984 | Bailey | 220/90.4 |
| 4,502,608 | 3/1985 | Mills | 220/90.4 |
| 4,629,088 | 12/1986 | Durgin | 220/254 |
| 4,738,373 | 4/1988 | DeParales | 220/254 |
| 4,949,865 | 8/1990 | Turner | 220/90.4 |

*Primary Examiner*—Stephen P. Garbe
*Assistant Examiner*—Stephen Cronin
*Attorney, Agent, or Firm*—Donald E. Hewson

[57] ABSTRACT

A thin plastic disposable lid for use with a cup, typically a disposable plastic styrofoam or paper container, is disclosed. The lid includes a small foldback portion that is partially removed from the remainder of the lid by tearing it along tear lines that are coincident with the oriented fibers of the plastic material, thus creating an opening in the lid. No pre-formed score lines, slits or notches are required to facilitate proper tearing of the lid. Further, the foldback portion is hinged and retained in intimate engagement by the lid when it is fully open. A specific feature of the lid is that the foldback portion is easy to fold back and to engage. The foldback portion is also resealable over the opening in the lid.

9 Claims, 2 Drawing Sheets

CUP LID

FIELD OF THE INVENTION

This invention relates to disposable cup lids and more particularly to such lids that are disposable and meant for a single use to cover plastic, foam or paper cups and containers. Such cups and containers are typically used to contain coffee, hot chocolate, milk, soft drinks, and the like. Such lids preferably have a portion that is partially torn away, but still remains attached to the lid to allow access to the liquid contained therein while still permitting most of the opening of the cup or container to remain covered. Further, the portion that is torn away is preferably replaceable.

BACKGROUND OF THE INVENTION

It is very common practice in today's society to obtain a beverage, whether it be coffee, tea, a soft drink, milk, juice, and so on, from a source other than one's home. Such sources include donut shops, variety stores, fast food outlets, coffee trucks, and a large number of like places. Often, such beverages are obtained while travelling, very often while travelling in a car, and will be consumed while travelling. In any event, it is desirable that the drinking vessels in which they are sold be covered for at least two reasons. Firstly, covering the cup would preclude spilling the contained beverage. Secondly, if the contained beverage in the cup is hot, the lid will help insulate the beverage from the surrounding and ambient air, thus keeping some of the heat in.

The term cup is used to denote a drinking vessel, a container, a glass, a bowl, a dish, a mug, a tumbler, or anything similar. Such cups can contain food, hot beverages, or cold beverages, or anything similar.

Such lids are typically made of thin inexpensive plastic, since they are meant to be disposable. Since they are made of thin plastic, it is fairly easy to tear a portion of the lid such that an opening is created. This opening would allow liquid within the cup to be consumed while still keeping most of the lid in place. Originally, cup lids had no specific provision for removal of a piece of the lid in order to drink to contained beverage. Instead, a piece of the lid was merely ripped off, usually while the cup lid was in place over the cup. The ripping of the cup lid was fairly random given that there was no specific part of the lid that was adapted to be removed. Often, too much or too little of the lid was ripped and removed. If too little was removed, some more could be removed until the desired size opening is achieved, however, this makes the process unnecessarily difficult, and does not guarantee that too large an opening won't result. If the cup lid is torn and too large an opening results, then it is more likely that beverage contained with in the cup would spill from the cup.

Cup lids are generally made from a thin sheet of extruded polystyrene material. This polystyrene sheet has associated with it orientation lines that are caused by the extrusion process. The polystyrene material readily tears along these orientation lines, but does not tear readily in other directions. In order to form the cup lids from the polystyrene sheet, the polystyrene is either run through a thermoforming machine immediately after it is extrudedor the polystyrene may be firmly rolled and stored and then run through a thermoforming machine.

In the molding machine, the polystyrene sheet is placed over a male mold. The polystyrene is shaped to the mold by means of suction through small openings in the mold. Pressurized air on the other side of the sheet forces the polystyrene against the mold, so that it generally conforms to the entire outline of the mold.

More recently produced cup lids often have some means by which a flap portion of the lid, which is to be torn away and thereby produce an opening, is defined by plurality of score lines or the like. Typically, a tab that is an extension of the flap protrudes outwardly from the edge of the cup lid. To tear the flap from the remainder of the lid, thus creating an opening for drinking, the tab is grasped and lifted upwardly. The lid begins to tear at the base of the tab and continues to tear along the imprinted score lines. Sometimes, a cup lid will have notches or slits at the base of the tab, which lead into the score lines. Such notches or slits ensure that the tear or tears in the cup lid are started in the correct spot.

There are a number of problems with using the score lines method of defining an opening in a cup lid. Firstly, it is difficult to produce cup lids with accurate score lines given that such a thin plastic material is used.

The general shape of the cup lid is of course circular, with a substantial portion of it being a generally planar body. There is also a circumferential displaced lip depending from the generally planar body, with the lip adapted to fit over the edge of a styrofoam or paper rolled-edge cup. The planar top portion of the lid typically has an upwardly directed angular channel that forms an annular lip that is adapted to receive the top portion of the cup. The planar portion of the lid is generally recessed slightly below the top of the cup. There is also typically a small ridge within the top planar portion of the lid that is located so as to preclude the tearing of the opening such that the opening will not become too large.

Another feature found on many cup lids is a means for holding the flap open so that a person can drink from the cup through the opening in the lid without the flap getting in the way. In use, once the flap is torn back thus creating an opening, it can then be folded over onto the lid where a portion of the flap is received by a mating portion of the lid. This mating portion of the lid is shaped so as to retain a portion the flap in frictional relation therewith, in the folded back position.

It has been found that there is a disadvantage in making the opening in the cup lid large, as most are. A person must be very cautious in order to drink from the cup without spilling, and must cover the opening entirely with their mouth while drinking.

It has being found that in many prior art type lids, when a portion of the flap is retained by the cup lid usually the end portion of the flap—the middle portion tends bow out, or alternatively the lip portion of the flap tends to stick up. These problems are more prevalent in cup lids having a large flap. In any event, part of the flap can be in the way of a person who is drinking from the cup—usually in the way of the person's nose. Such a problem could be precluded by having a smaller opening in the lid and therefore a smaller flap, with an improved means for holding the open flap on to the cup lid.

DESCRIPTION OF THE PRIOR ART

U.S. Pat. No. 3,977,559 to Lombardi discloses a lid for a food container having a flip-open section within the lid. The flip-open section is pre-scored so that it may be easily lifted and torn away from the remainder of the lid by grabbing a tab and lifting and pulling. The orientation of the score lines of the flip open section generally do not coincide with the orientation lines of the plastic of the lid.

U.S. Pat. No. 4,322,015 to Bailey discloses a container lid having an access strip 25 that is defined by a pair of tear impressions 22 and is opened by lifting an extended edge section 26 upwardly such that the access strip 25 is torn upwardly out of the lid. There are slits or notches in the edge of the lid that defines the start of the tearing impression 22 and ensure that the access strip 25 is torn accurately.

U.S. Pat. No. 4,473,167 to Bailey discloses a container lid construction having a large access strip within the lid. The access strip is defined by a score line on each side thereof. The access strip is torn from the remainder of the lid by lifting an edge section that extends outwardly from the access strip and tearing it towards the centre of the lid. In order to ensure that the lid tears properly along the score line there is a pair of notches, one for each score line, in the edge of the lip at the beginning the score lines.

U.S. Pat. No. 4,502,608 to Mills (and assigned to a common assignee herewith) discloses a disposable lid for drinking cups wherein a portion of the lid is removed by pulling tab portion 44. When tab portion 44 is pulled, the lid starts to tear at the notches 20 in skirt portion 16. Preferably, the lid tears along imaginary radial lines 32 and 34, or at least approximately along these radial lines, until the tears reach cut 28, which precludes further tearing. There is, unfortunately, no specific means for controlling exactly where the tearing will take place, even though it starts off at predetermined notches or slits.

U.S. Pat. No. 4,629,088 to Gerken discloses a container lid with a drink through opening which discloses a lid with a flap, with the flap being defined by score lines. To lift the flap, a pull tab is lifted and the lid tears along the score lines until a hinge line is reached. The flap then folds back and is held in place folded onto the lid by mating of an indentation on the flap with a transverse detent in the lid.

U.S. Pat. No. 4,738,373 to De Parales discloses a cup cover having opening means which is a tab that is defined by a pair of score lines. The tab is separated by lifting an extended portion 39 of the tab upwardly, and folding the tab over across the lid. The portion of the rib 14 on the tab is inserted into a recess 40, thereby retaining the tab in an open position.

SUMMARY OF THE INVENTION

The present invention provides a cup lid for closure over the opening of a disposable cup, typically made of plastic, foam or paper, the lid being easy to manufacture, easy to use, easy to drink from, and resealable. The lid has within it a small foldback portion that is partially removable by tearing it from the remainder of the lid. In order to tear the foldback portion from the remainder of the lid a grasp tab is grasped and is pulled towards the centre of the lid. The foldback portion is oriented such that the two sides of it are aligned along the orientation lines of the extruded plastic material that the lid is formed from. The foldback portion generally tears along these orientation lines thus forming an opening of a generally predefined size and shape. There are no score lines to help define the foldback portion and there are no slits or notches in the side of the lid to help start the tearing of the foldback portion. This is advantageous in the manufacture of such a lid in that it makes the manufacturing process much easier. Since score lines are out only part way into a lid, and the lids are made of a very thin plastic material, it is difficult to keep the score lines cut to an accurate depth. Resultingly, an unacceptably high percentage of lids with score lines have score lines that have been cut completely through the material or that are too shallow to be as effective as required. This can result in leakage, especially if the cup of container is carried in a bag, where it may easily assume a non-vertical orientation.

The opening that is created by partial removal of the foldback portion from the lid is relatively small for a number of reasons—there is less spillage if the cup should tip over, it is easier to drink from, it is easier to open and lock the foldback portion in place in its opened position.

The disposable lid of the present invention also provides an improved mechanism for locking the foldback portion in place on the remainder of the lid. This mechanism consists of at least one protruding tab on the foldback portion, which also strengthens the foldback portion, and at least one co-operating protrusion properly placed on the lid so as to receive and retain the at least one protruding tab in intimate engagement therewith.

Further, in an alternative embodiment, there is provided a recess that accommodates the at least one co-operating protrusion and also generally accommodates the foldback portion of the lid when the foldback portion is indeed folded over onto the lid. This allows the foldback portion to remain generally flush with the lid thus allowing for cup to be stacked on top of other cups when the foldback portion is open.

Also, there is provided a means for providing a positive locking action of the foldback portion onto the remainder of the lid.

BRIEF DESCRIPTION OF THE DRAWINGS

Embodiments of this invention will now be described by way of example in association with the accompanying drawings in which.

DETAILED DESCRIPTION OF THE PREFERRED EMBODIMENTS

Figure 1:
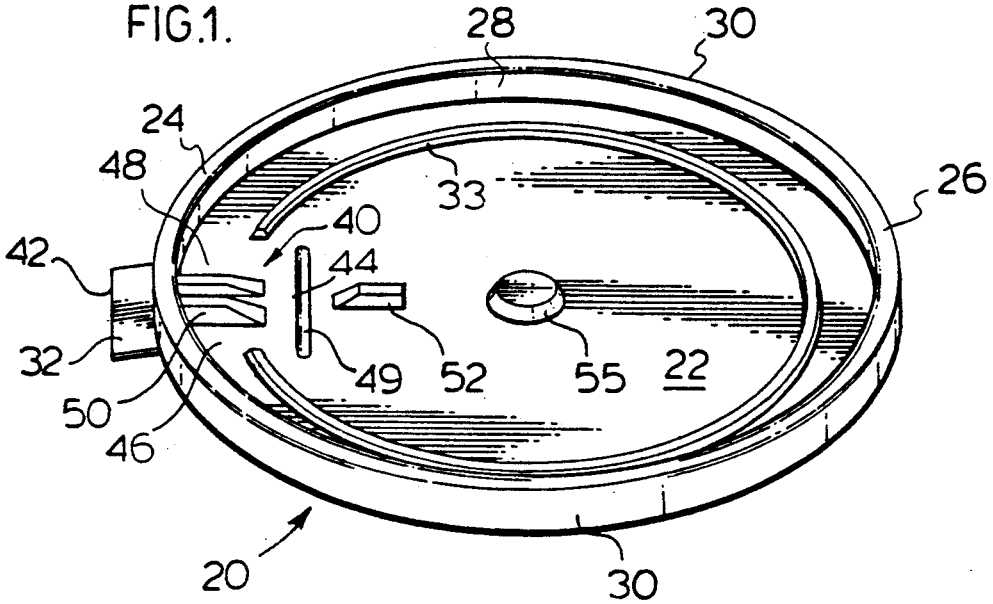
FIG. 1 is a perspective view of the cup lid of the present invention.

Reference will now be made to FIG. 1, in which a preferred embodiment of the disposable cup lid 20 is shown. The cup lid 20 is substantially circular in shape so as to fit onto the mouth of a paper or styrofoam cup. The lid 20 has a cover portion 22 and a lip portion 24. The cover portion 22 generally spans across the opening of a cup when the lid 20 is placed thereon.

When the lid 20 is initially placed on the cup, the lid 20 is intact and covers the entire opening of the cup, with the exception of a small air hole in the centre area of the lid. It also mates tightly with the cup, thereby forming a virtually leakproof seal over the cup, except for the small air hole, which may allow a very minute amount of liquid contained within the cup to escape.

The lip portion 24 of the lid 20 is displaced preferably around the perimeter of cover portion 22 and forms the outside edge of the lid 20. The lip portion 24 is in the form of an annular inverted channel so as to properly accept and intimately engage with the rim of a co-operating cup. The lip portion 24 comprises a top surface 26, and inner side surface 28, and outer side surface 30. The top surface 26 is adapted to be in intimate engagement with the very top portion of the rim of a co-operating cup. The top surface 26 also join, the inside surface 28 and the outer side surface 30. The inner side surface 28 is adapted to be in intimate engagement with the portion of the inside surface of the co-operating cup and the outer side surface 30 is adapted to be in intimate engagement with a portion of the outer side surface of a co-operating cup. The distance between the inner side surface 28 and the outer side surface 30 is such that the lip portion 24 fits tightly onto and remains in intimate engagement with the rim of a co-operating cup. Protruding outwardly from a minor segment of said lip portion 24 is grasp tab 32, which will be discussed subsequently.

The cover portion in 22 is generally planar and spans across the opening of a cup that is being covered by lid 20. There is a generally circular ridge 33 near the periphery of the cover portion 22. This ridge 33 is included to provide increased overall structural strength to the lid 20.

The cover portion 22 has a foldback portion 40 located therein near the periphery of the cover portion 22. The foldback portion 40 extends into the lip portion 24 and spans a minor segment of the cover portion 22 and lip portion 24. The foldback portion 40 has a first end 42 at the end of a grasp tab 32, a second end 44 located inwardly on the cover portion 22 at the hinge 49, a first side 46, and a second side 48. The first side 46 and the second side 48 are tear lines. The tear lines do not actually exist until the foldback portion 40 is partially removed from the remainder of the lid. The foldback portion 40 is partially removed from the cover portion 22 by lifting grasp tab 32 and tearing the foldback portion 40 inwardly into the cover portion along tear lines that define first side 46 and second side 48. The foldback portion 40 is torn until hinge 49 is reached. At that point, the tearing operation generally is precluded and then becomes a bending operation of the hinge 49, which is a living hinge. The hinge 49 is substantially "U"-shaped and the material is thinner at the hinge since the plastic sheet has been stretched over an area that is about two or three times the surface area than the original amount of material that is used to form the hinge. Resultingly, the material at the hinge is also one half to one third the thickness as the surrounding material. The combination of the thinner material and the "U"-shaped of the hinge permits easy bending of the material such that the tearing of the material is generally preclude at the hinge, even though the material could be torn past the hinge if desired.

At the hinge, foldback portion 40 is merely folded over onto the cover portion 22. In order to keep the foldback portion 40 in contact with cover portion 22 so that the foldback portion 40 does not come back and interfere with access to the opening that is now being created in lid 20, it is held in place by a pair of protruding tabs 50 which interface with a co-operating protrusion 52 located inwardly therefrom on cover portion 22. The co-operating protrusion 52 retains the pair of protruding tabs 50 in intimate relation by friction, stiction, or any other appropriate physical means.

The foldback portion 40 tears in given directions along first side 46 and second side 48 because the plastic material that is used to form the lid 20 has generally linear orientation lines therein. During the formation of lid 20, the orientation lines in the material and the lid 20 are arranged such that the first side 46 and second side 48 are aligned along the direction of the extrusion so that the tear lines will be along the orientation lines of the material. This allows the lid 20 to be formed without the inclusion of score lines to assist or promote the tearing of the foldback portion 40, and also without any notches or slits in the outer side surface 30 of lip portion 24. Notches or slits were typically found in the Prior Art, and were used to lead into tear lines. It is more difficult to properly form a lid that has notches or slits and especially score lines, and it is therefore preferable to have a lid that will have an opening that is produced by partially removing a portion such as foldback portion 40 without the aid of score lines, notches or slits.

It is important that the width of the foldback portion 40, which is a minor segment of the substantially circular lid 20, is small enough that the opening created by partial removal of the foldback portion 40 can be easily covered by a person's mouth during drinking. Spillage is thereby generally precluded when drinking. In the preferred embodiment, the length of the foldback portion 40 is smaller than is found under the Prior Art, and is important for several reasons. Firstly, it creates a smaller opening so that one's mouth can fit completely over the opening while drinking. Secondly, it precludes a portion of the foldback portion 40 from extending to the other side of the cover portion 22 when fully opened. This is undesirable because it has been found in the Prior Art that foldback portions of such sides can tend to bow upwardly when they are folded back to the other side of the cover portion which causes them to interfere somewhat with drinking by getting in the way of a person's nose. Further, it has been found that by having a shorter foldback portion 40, there tends to be less spillage of liquid contained within a cup if the cup is knocked over while lid 20 is in place and the foldback portion 40 is opened. Further, it has also been found that by having a shortened foldback portion 40, with protruding tabs 50 thereon and a co-operating protrusion 52 located on the cover portion 22 of the lid 20, it is easier to fold the foldback portion 40 onto the cover portion 22 and have it retained thereon.

It must be understood, however, that the foldback portion 40 may also be fairly large. The size of the foldback portion 40 does not affect the operation thereof in terms of interaction of the protruding tabs 50 on the co-operating protrusion 52, nor in terms of the foldback portion 40 tearing along the orientation lines of the plastic material.

The lid 20 also has a generally circular central protrusion 55 that typically contains a vent hole. This vent hole allows for passage of air to the outside when applying the lid to the cup. It is also possible to include an "X"-shaped cut in the central protrusion 55 so as to accommodate passage of a straw.

Figure 2:
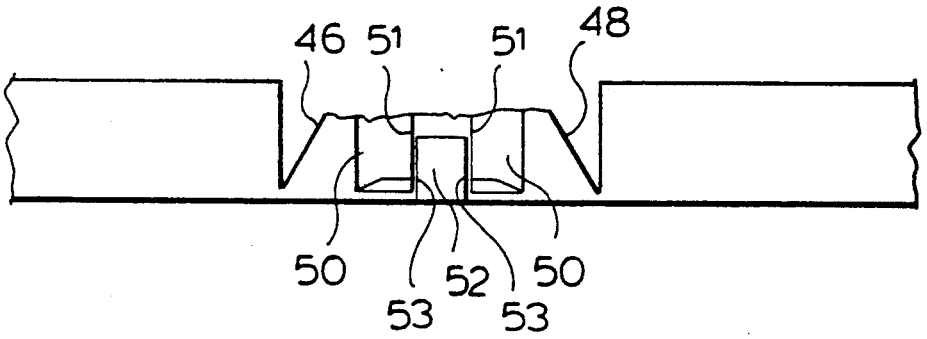
FIG. 2 is a partially cut a way view of a portion of the cup lid.

Reference will now be made to FIG. 2 which shows foldback portion 40, with an outer portion thereof removed for clarity, folded back onto the cover portion 22 such that protruding tabs 50 are in intimate engagement with co-operating protrusion 52. It can be seen that in the outer walls 53 of the co-operating protrusion 52 are in intimate engagement with the corresponding inner walls 51 of the pair of protruding tabs 50.

Figure 3:
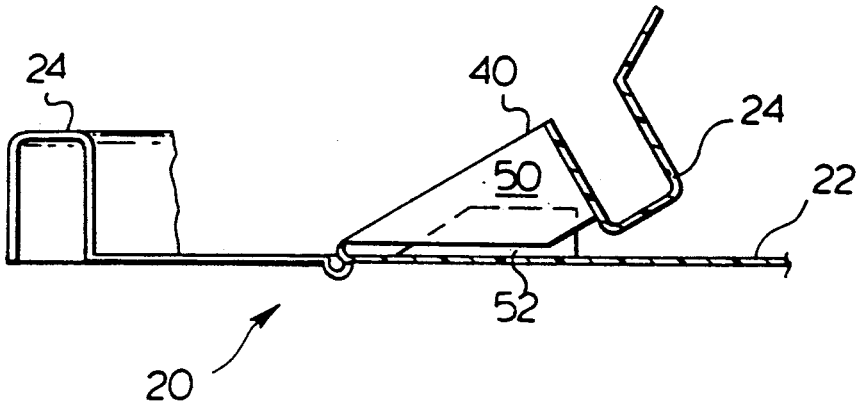
FIG. 3 is a side view of the portion of the cup lid shown in FIG. 2.

FIG. 3 shows the foldback portion 40 in an open position folded over onto cover portion 22. The protruding tab 50 is retained in intimate engagement by co-operating protrusion 52.

It can be seen in FIGS. 2 and 3 that the foldback portion 40 is merely to be folded over onto the cover portion 22 after it is partially removed from lid 20 along its tear lines. The exact positioning of the lid portion 24 on the foldback portion 40 is not overly important in that it does not have to be received by cover portion 22 at a specific place. In order for co-operating protrusion 52 to receive the protruding tabs 50 properly, all that is necessary is that the foldback portion 40 be torn in a proper direction inwardly along the orientation lines of the plastic. The distance of the tear is generally regulated by the hinge 49, and the exact distance that the lip portion 24 on foldback portion 40 reaches along cover portion 22, are not important. This makes the folding back and subsequent engagement of the foldback portion 40 on the cover lid portion 22 very easy.

Further, it is also easy to remove the foldback portion 40 from cover portion 22 and fold it back over the opening that has been created and thereby re-attach it onto the rim of the cup.

It has also been found that the pair of protruding tabs 50 coupled with the lid portion 24 on the foldback portion 40 give a relatively high degree of strength and rigidity to foldback portion 40. This is advantageous in making the foldback portion 40 easier to foldback and also easier to lock in place against the cover portion 22.

Figure 4:
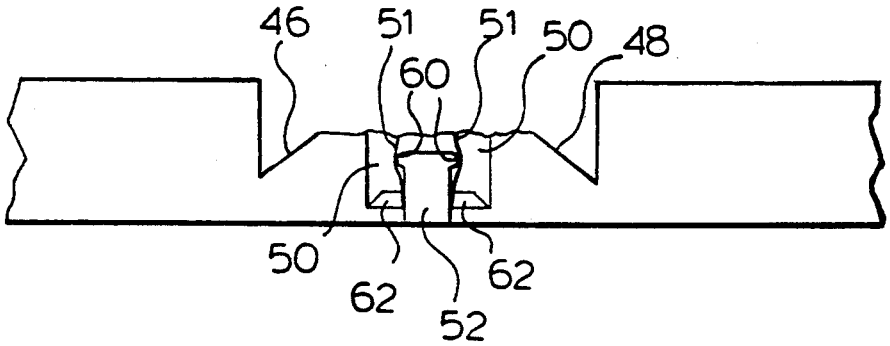
FIG. 4 is a view similar to FIG. 2, but showing an alternative embodiment.

In an alternative embodiment, as shown in FIG. 4, the co-operating protrusion 52 has a pair of small projections 60, with one of the projections 60 located on one of the outer walls 53 and the other of the projections 60 being located on the opposite of the outer walls 53. These projections 60 cause the inner walls 51 of the pair of protruding tabs 50 to deform inwardly when the foldback portion 40 is retained in place on the cover portion 22. When the foldback portion 40 is being put into place or being removed therefrom, the top portion 62 of each of the protruding tabs 50 must also be deformed by the projections 60 on the co-operating protrusion 52. Since these top portions are more difficult to deform than are the inner walls 51, there is a locking effect as the top portion 62 passes over the projections 60. This allows the foldback portion 40 to be locked in place on the cover portion 22 without chance of it slipping out of place unwantedly.

Figure 5:
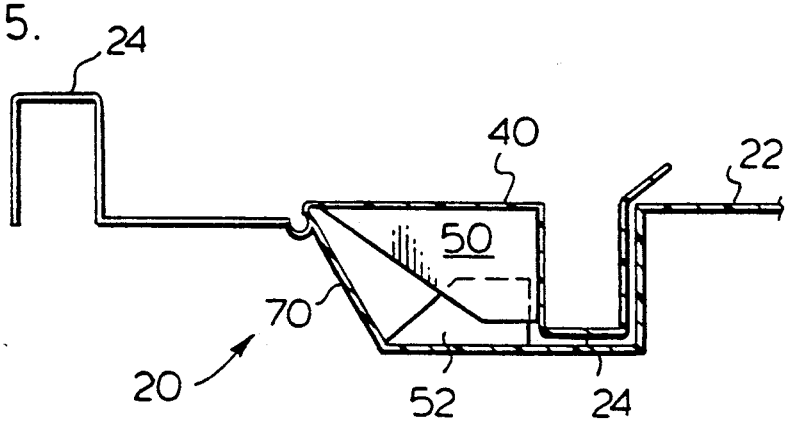
FIG. 5 is a side view of the partially cut away view of FIG. 4.

In a further alternative embodiment, as shown in FIG. 5, there is a recess 70 in cover portion 22 of lid 20, which contains the co-operating protrusion in 52 therein. The recess 70 also provides room for lip portion 24 on foldback portion 40 such that when the foldback portion 40 is folded over, it can sit reasonably flush within cover portion 22. This as an advantage in that the foldback portion 40 is even more out of the way of a person trying to drink through the opening in the lid. It also allows drinking vessels to be stackable one on top of the lid of another when the foldback portion 40 is opened.

Figure 6:
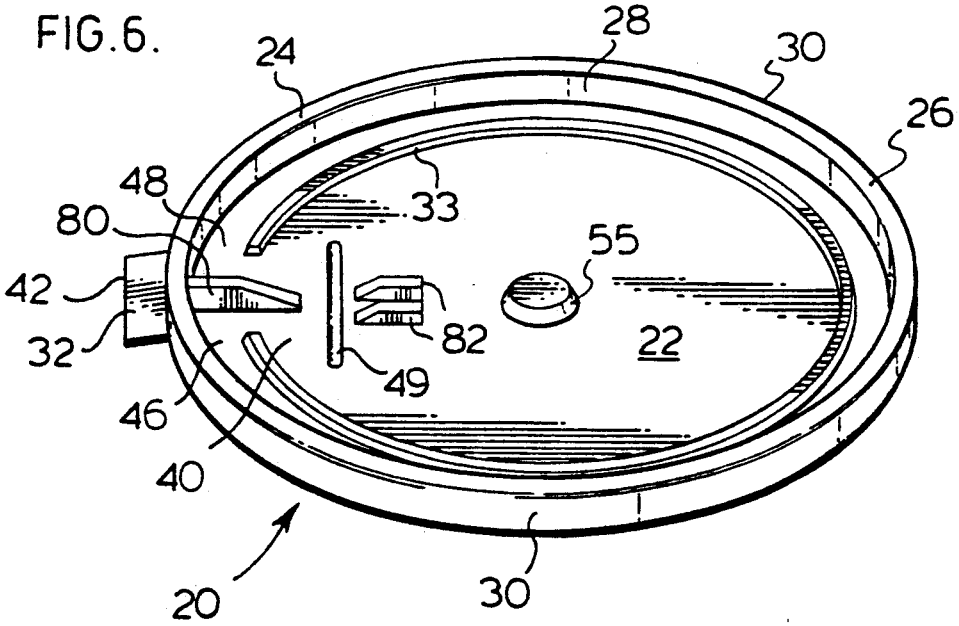
FIG. 6 is a perspective view of an alternative embodiment of the cup lid.

In yet a further alternative embodiment, as shown in FIG. 6, there is a single protruding tab 80 and a pair of co-operating protrusions 82 on the foldback portion 40. The protruding tab 80 intimately engages with the pair of co-operating protrusions 82 in the same manner as the pair of protruding tabs 50 intimately engage with the co-operating protrusion 52, in the preferred embodiment.

It should be noted that other modifications and alterations may be made to the design of the cup lid as described above without departing from the spirit and scope of the appended claims.

I claim:

1. A substantially circular disposable lid adapted for secure placement onto a cup and over the opening therein, made from a plastic material having orientation lines caused by extrusion, comprising:

a cover portion and lip portion;

said lip portion being displaced peripherally around said cover portion and adapted to allow said lid to engage a corresponding rim on the cup, said lip portion having a grasp tab exending from the periphery thereof;

said cover portion being generally planar and having a foldback portion therein located near the periphery of said cover portion and extending into said lip portion and spanning a minor segment of said cover portion and said lip portion, and also having a generally circular ridge near the periphery of said cover portion, said ridge providing overall structural strength to said cover portion, at least one co-operating protrusion for receiving and retaining said foldback portion, and a "U"-shaped hinge;

each of said at least one co-operating protrusion having a pair of outer walls that are adapted to be in intimate contact with said foldback portion;

said foldback portion having a first side, a second side, a first end, and a second end, said first end being coincident with said grasp tab of said lip portion and said second end being coincident with said "U"-shaped hinge;

said foldback portion being adapted to be lifted at its end and partially separated from the rest of said lid by lifting said foldback portion and tearing it inwardly, said foldback portion separating from the rest of said lid along a pair of tear lines, one on each side of said foldback portion with said tear lines defining the first and second sides of said foldback portion;

said foldback portion including at least one protruding tab for interfacing with said at least one co-operating protrusion on said cover portion, each of said at least one protruding tab having an inner wall that is adapted to be in intimate engagement with one of said outer walls of said co-operating protrusion;

wherein said "U"-shaped hinge is adapted to preclude said foldback portion from tearing further into said lid by bending once said tear lines reach said hinge; and wherein said lid is oriented in a direction in said plastic material in such a manner that said tear lines are oriented along said orientation lines of said material and are defined solely as a consequence thereof.

2. The disposable lid of claim 1, including two protruding tabs and one co-operating protrusion.

3. The disposable lid of claim 1, including one protruding tab and two co-operating protrusions.

4. The disposable lid of claim 1, also having a recess within said cover portion and with said recess accommodating said at least one co-operating protrusion and said recess also accomodating said lip portion on said foldback portion when said foldback portion is folded over.

5. The disposable lid of claim 1, including at least one projection located on one of said at least one outer wall of said at least one co-operating protrusion.

6. The disposable lid of claim 1, including two projection, one on each outer wall of said at least one co-operating protrusion.

7. A substantially circular disposable lid adapted for secure placement onto a cup and over the opening therein, made from a plastic material having orientation lines caused by extrusion, comprising:

a cover portion and lip portion;

said lip portion being displaced peripherally around said cover portion and adapted to allow said lid to engage a corresponding rim on the cup, said lip portion having a grasp tab extending from the periphery thereof;

said cover portion being generally planar and having a foldback portion therein located near the periphery of said cover portion and extending into said lip portion and spanning a minor segment of said cover portion and said lip portion, and a "U"-shaped hinge;

said foldback portion having a first side, a second side, a first end, and a second end, said first end being coincident with said grasp tab of said lip portion and said second end being coincident with said "U"-shaped hinge;

said foldback portion being adapted to be lifted at its end and partially separated from the rest of said lid by lifting said foldback portion and tearing it inwardly, said foldback portion separating from the rest of said lid along a pair of tear lines, one on each side of said foldback portion with said tear lines defining the first and second sides of said foldback portion;

wherein said "U"-shaped hinge is adapted to preclude said foldback portion from tearing further into said lid by bending once said tear lines reach said hinge; and wherein said lid is oriented in a direction in said plastic material in such a manner that said tear lines are oriented along said orientation lines of said material and are defined solely as a consequence thereof.

8. A substantially circular disposable lid adapted for secure placement onto a cup and over the opening therein, made from a plastic material having orientation lines caused by extrusion, comprising:

a cover portion and lip portion;

said lip portion being displaced peripherally around said cover portion and adapted to allow said lid to engage a corresponding rim on the cup, said lip portion having a grasp tab extending from the periphery thereof;

said cover portion being generally planar and having a foldback portion therein located near the periphery of said cover portion and extending into said lip portion and spanning a minor segment of said cover portion and said lip portion, and also having a generally circular ridge near the periphery of said cover portion, said ridge providing overall structural strength to said cover portion, at least one co-operating protrusion for receiving and retaining said foldback portion, and a "U"-shaped hinge;

each of said at least one co-operating protrusion having a pair of outer walls that are adapted to be in intimate contact with said foldback portion and which are substantially radially oriented;

said foldback portion having a first side, a second side, a first end, and a second end, said first end being coincident with said grasp tab of said lip portion and said second end being coincident with said "U"-shaped hinge;

said foldback portion being adapted to be lifted at its end and partially separated from the rest of said lid by lifting said foldback portion and tearing it inwardly, said foldback portion separating from the rest of said lid along a pair of tear lines, one on each side of said foldback portion with said tear lines defining the first and second sides of said foldback portion;

said foldback portion including at least one protruding tab for interfacing with said at least one co-operating protrusion on said cover portion, each of said at least one protruding tab having an inner wall that is adapted to be in intimate engagement with one of said outer walls of said co-operating protrusion;

wherein said "U"-shaped hinge is adapted to preclude said foldback portion from tearing further into said lid by bending once said tear lines reach said hinge; and wherein said lid is oriented in a direction in said plastic material in such a manner that said tear lines are oriented along said orientation lines of said material and are defined solely as a consequence thereof.

9. A substantially circular disposable lid adapted for secure placement onto a cup and over the opening therein, made from a plastic material having orientation lines caused by extrusion, comprising:

a cover portion and lip portion;

said lip portion being displaced peripherally around said cover portion and adapted to allow said lid to engage a corresponding rim on the cup, said lip portion having a grasp tab extending from the periphery thereof;

said cover portion being generally planar and having a foldback portion therein located near the periphery of said cover portion and extending into said lip portion and spanning a minor segment of said cover portion and said lip portion, and also having a generally circular ridge near the periphery of said cover portion, said ridge providing overall structural strength to said cover portion, at least one co-operating protrusion for receiving and retaining said foldback portion, and a "U"-shaped hinge;

each of said at least one co-operating protrusion having a pair of outer walls that are adapted to be in intimate contact with said foldback portion;

said foldback portion having a first side, a second side, a first end, and a second end, said first end being coincident with said grasp tab of said lip portion and said second end being coincident with said "U"-shaped hinge;

said foldback portion being adapted to be lifted at its end and partially separated from the rest of said lid by lifting said foldback portion and tearing it inwardly, said foldback portion separating from the rest of said lid along a pair of tear lines, one on each side of said foldback portion with said tear lines defining the first and second sides of said foldback portion;

said foldback portion including at least one protruding tab for interfacing with said at least one co-operating protrusion on said cover portion, each of said at least one protruding tab having an inner wall that is adapted to be in intimate engagement with one of said outer walls of said co-operating protrusion;

wherein said "U"-shaped hinge consists only of a single "U"-shaped member and is adapted to preclude said foldback portion from tearing further into said lid by bending once said tear lines reach said hinge; and wherein said lid is oriented in a direction in said plastic material in such a manner that said tear lines are oriented along said orientation lines of said material and are defined solely as a consequence thereof.

* * * * *